US005526028A

United States Patent [19]

Rottman

[11] Patent Number: 5,526,028

[45] Date of Patent: Jun. 11, 1996

[54] LIQUID INK PRINTER TRANSPORT BELT CLEANER

[75] Inventor: Robert M. Rottman, Ontario, N.Y.

[73] Assignee: Xerox Corporation, Stamford, Conn.

[21] Appl. No.: 452,168

[22] Filed: May 26, 1995

[51] Int. Cl.[6] ..... B41J 2/165

[52] U.S. Cl. ..... 347/23; 347/104

[58] Field of Search ..... 347/104, 22, 23, 347/33; 355/297, 300

[56] References Cited

U.S. PATENT DOCUMENTS

| | | | |
|---|---|---|---|
| 3,867,170 | 2/1975 | Ferguson et al. | 117/37 LE |
| 4,207,579 | 6/1980 | Gamblin et al. | 347/104 |
| 4,568,174 | 2/1986 | Stange | 355/300 |
| 4,967,238 | 10/1990 | Bares et al. | 355/297 X |
| 5,225,852 | 7/1993 | Uchida et al. | 347/104 X |
| 5,225,853 | 7/1993 | Kobayashi et al. | 347/104 X |

FOREIGN PATENT DOCUMENTS

| | | |
|---|---|---|
| 4-197639 | 7/1992 | Japan . |
| 4-325276 | 11/1992 | Japan . |
| 5-131618 | 5/1993 | Japan . |

*Primary Examiner*—Nestor R. Ramirez
*Attorney, Agent, or Firm*—Daniel J. Krieger

[57] ABSTRACT

A cleaning apparatus for cleaning a transport belt in a printing machine of the type in which liquid ink is deposited on a recording medium moved along a path by the transport belt. The cleaning apparatus located next to the transport belt cleans a first surface and a second surface of the transport belt when ink and/or other contaminants collect on the belt. A sensor senses when the belt needs cleaning. Interior side walls of apertures within the belt which enable vacuum transport of the recording medium through the printing machine are also cleaned. The cleaning apparatus includes a first cleaning device having a flexible web for cleaning the first surface of the transport belt and a second cleaning device having a flexible web for cleaning the second surface of the transport belt. The sensor includes a length sufficient to sense contaminants along the width of the transport belt.

19 Claims, 3 Drawing Sheets

LIQUID INK PRINTER TRANSPORT BELT CLEANER

FIELD OF THE INVENTION

This invention relates generally to printing in a liquid ink printer and more particularly to cleaning a transport belt which transports recording sheets through the printer during printing.

BACKGROUND OF THE INVENTION

Liquid ink printers of the type frequently referred to as continuous stream or as drop-on-demand, such as piezoelectric, acoustic, phase change wax-based or thermal, have at least one printhead from which droplets of ink are directed towards a recording sheet. Within the printhead, the ink is contained in a plurality of channels. Power pulses cause the droplets of ink to be expelled as required from orifices or nozzles at the end of the channels. Continuous ink stream printers are also known.

In a thermal ink-jet printer, the power pulses are usually produced by resistors, each located in a respective one of the channels, which are individually addressable to heat and vaporize ink in the channels. As voltage is applied across a selected resistor, a vapor bubble grows in that particular channel and ink bulges from the channel orifice. At that stage, the bubble begins to collapse. The ink within the channel retracts and separates from the bulging ink thereby forming a droplet moving in a direction away from the channel orifice and towards the recording medium whereupon hitting the recording medium a spot is formed. The channel is then refilled by capillary action, which, in turn, draws ink from a supply container of liquid ink. Operation of a thermal ink-jet printer is described in, for example, U.S. Pat. No. 4,849,774.

The ink-jet printhead may be incorporated into either a carriage-type printer or a page-width type printer. The carriage-type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. The procedure is repeated until the entire page is printed. In contrast, the page-width printer includes a stationary printhead having a length equal to or greater than the width or length of a sheet of recording medium. The paper is continually moved past the page-width printhead in a direction substantially normal to the printhead length and at a constant or varying speed during the printing process. A page-width ink-jet printer is described, for instance, in U.S. Pat. No. 5,192,959.

It has been recognized that there is a need to maintain the ink ejecting nozzles of liquid ink printheads, such as an ink-jet printhead, by periodically cleaning the orifices when the printhead is in use by purging or vacuum withdrawal of ink and/or by capping the printhead when the printer is out of use or is idle for extended periods. The capping of the printhead is intended to prevent the ink in the printhead from drying out. There is also a need to prime or to purge the printhead nozzles before use and occasionally during use to ensure that the printhead channels are completely filled with ink, contain no contaminants or air bubbles, and do not dry out from not being used. Typically, the ink-jet printhead is moved into position or vice versa with a maintenance and/or priming station for printheads of ink-jet printers. In a page-width printhead, the maintenance of the nozzles throughout the entire length of the printhead is especially critical since not all of the individual jets may be fired during the printing of a single sheet of paper or over many sheets of paper.

On occasion, ink can collect on the transport belt during purging of the printhead nozzles, during routine maintenance of the printhead, or during printing itself if a paper jam occurs and ink is deposited onto the transport belt instead of onto the recording medium. Consequently, while a liquid ink printer is designed to effectively control any undesirable depositing of ink on the transport belt, such situation do arise. Consequently, it is desirable to clean the transport belt of ink and/or other contaminants before printing is resumed, since ink deposited on the belt can ruin an otherwise perfectly printed recording medium.

Various cleaning mechanisms for cleaning belts and other devices present in printing machines are illustrated and described in the following disclosures which may be relevant to certain aspects of the present invention.

In U.S. Pat. No. 3,867,170 to Ferguson et al., a method for cleaning liquid developers from the imaging surface of an electrostatographic imaging system is described. The imaging surface is cleaned with a cleaning liquid which is miscible with the liquid developer. A cleaning web absorbs the cleaning liquid and contacts the imaging surface to dilute and dissolve the liquid developer.

U.S. Pat. No. 4,568,174, to Strange, describes a photoreceptor descumming device for cleaning contaminants from a photoreceptor surface. The device includes a flexible web moving into engagement with the photoreceptor surface.

SUMMARY OF THE INVENTION

In accordance with one aspect of the present invention, there is provided a printing machine of the type in which liquid ink is deposited on a recording medium moving along a path. The printing machine includes a transport belt which moves the recording medium along the path. A sensor is disposed adjacently to the transport belt and senses contaminants on the transport belt. A cleaning apparatus is disposed adjacently to the transport belt and cleans the transport belt in response to the sensor sensing contaminants on the transport belt.

Other features of the present invention will become apparent as the following description proceeds and upon reference to the drawings, in which:

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
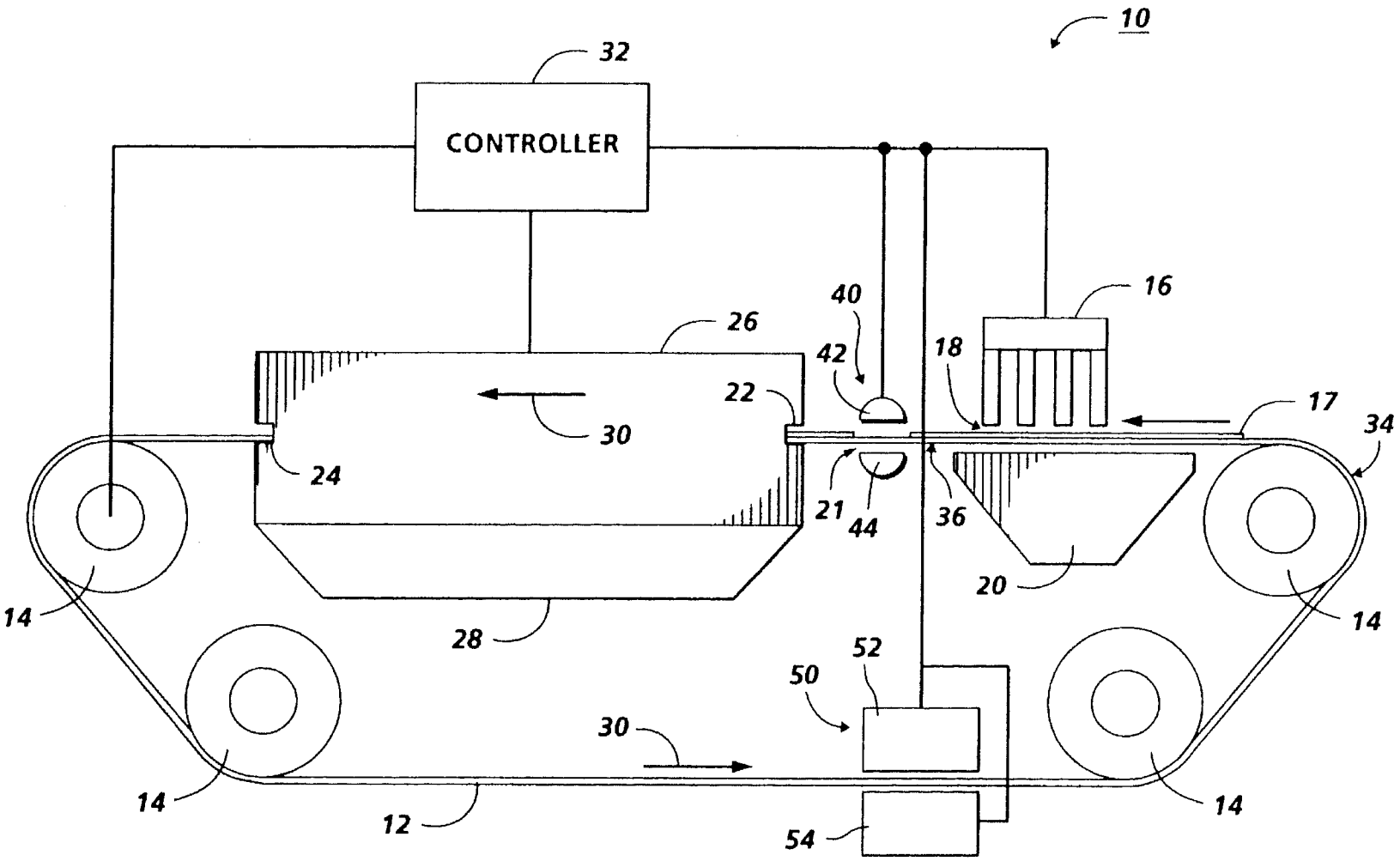
FIG. 1 is a schematic side elevational view of one embodiment of an ink-jet printer incorporating the present invention.

FIG. 1 illustrates a schematic side elevational view of an ink-jet printer 10. The ink-jet printer 10 includes an input tray (not shown) containing cut sheets of paper stock or transparencies for printing. Individual recording sheets are removed from the input tray and fed onto a transport belt 12 driven by rollers 14 beneath a printing member 16. The transport belt 12 is substantially transparent to microwave energy and includes a plurality of apertures 15 (see FIG. 2), with a height equal to the thickness of the belt 12, having interior walls through which a vacuum is applied to hold the printing sheet to the belt as it moves through the printer. Suitable materials include ULTEIVI, a polyetherimide, available from General Electric, KALADEX, a polyethylene napthalate, available from Imperial Chemical Industries (ICI) of Wilmington, Del., and other materials having a low dielectric constant that can be formed into a belt. The printing member 16 includes one or more page width ink-jet printheads which deposit liquid ink on a sheet of paper or transparency or other printing media as the belt 12 carries the recording sheet past the printing member 16.

As illustrated, the printing member 16 includes four page-width printbars for printing full color images comprised of the colors cyan, magenta, yellow, and black. Each of the page-width ink-jet printbars includes a linear array of print nozzles so that ink is deposited across the width or length of the sheet. The present invention is equally applicable, however, to printers having an ink-jet printhead or printheads which move across the sheet periodically in swaths, to form the image, and to printers having staggered arrays of printheads or to printers having a single printbar. The print member 16 includes an ink supply which may either be located with the printhead itself or may be located elsewhere and connected to the printhead through an ink conduit. In addition to an ink supply, the print member 16 includes the necessary electronics to control the deposition of ink on the individual sheets.

During printing, a recording sheet 17 is held to the transport belt 12 through a printing zone 18, by an applied vacuum from a first vacuum applicator 20. An interdocument region 21 is located between recording sheets 17 in areas where the transport belt 12 is not in contact with the recording sheets 17. Once printed, the printed recording sheet 17 enters an input slot 22 and exits an output slot 24 of a dryer 26. The dryer 26 has attached thereto a second vacuum applicator 28 for further application of a vacuum to the recording sheet 17 through the belt 12 as it traverses through the dryer 26 in the process direction of an arrow 30. The transport belt enables the use of a single transport for both imaging and drying. It is also possible that a single vacuum applicator could be used in both the imaging region 18 and the dryer 26. Once the liquid ink has been dried by the dryer 26, it exits the output slot 24 and is deposited in an output tray (not shown).

A controller 32 controls the printing member 16, the dryer 26, and the rollers 14, as would be understood by one skilled in the art. In addition, an adaptive dryer control for controlling the speed of the belt 12 through the dryer 26 can also be used. U.S. Pat. No. 5,214,442 entitled "Adaptive Dryer Control for Ink-Jet Processors", assigned to Xerox Corporation, discloses such an adaptive dryer control and is hereby incorporated by reference.

In the present embodiment of the invention, the dryer 26 includes a microwave dryer applying microwave power to dry the ink deposited on the recording sheet 17. A microwave dryer suitable for use in the present invention is described in U.S. patent application Ser. No. 08/159,908 entitled "Apparatus and Method for Drying Ink Deposited By Ink-Jet Printing" assigned to Xerox Corporation and filed Nov. 30, 1993, the relevant portions of which are incorporated herein by reference. Since a microwave dryer is being used, inks specially formulated to absorb microwave power are preferred. Such inks may include compounds designed to couple with the microwave power for increasing the amount of heat conducted thereby. One such compound is an ionic compound, at least ionizable in the liquid vehicle. U.S. Pat. No. 5,220,346 entitled "Printing Processes with Microwave Drying" assigned to Xerox Corporation, discloses a suitable ink and is hereby incorporated in this application by reference.

During operation of the ink jet printer 10, contaminants, such as ink or other debris, can collect on a surface 34 of the belt 12 instead of on the recording medium 17 due to malfunctions of the printer 10, such as paper jams, depositing ink in interdocument regions, and misdirected nozzles which could potentially deposit ink on the belt. The presence of ink on the belt causes a few significant problems. An ink contaminated belt quickly becomes damaged as the microwave dryer superheats the areas where the ink has been deposited. The belt gets deformed in these areas, since the ink acts as a heat sink, thereby superheating the belt. In these areas, the belt no longer lies perfectly flat and consequently the recording medium does not lie substantially perfectly flat which is necessary for proper printing. As the recording medium passes beneath the printbar, the gap between the printbars and the recording medium is no longer maintained. The loss of the proper gap does not only degrade the image being printed, but if the deformed belt causes the recording medium to contact the printhead, ink is smeared, thereby ruining the image and contaminating the belts even further. In addition, because the belt 12 includes the plurality of apertures 15, ink deposited on the belt surface contacting the recording sheet 17, can collect on the interior side walls of the belt apertures and even a surface 36 of the belt by moving through the apertures. Consequently, the present invention provides an apparatus for sensing ink on both sides of the belt and an apparatus for removing contaminants and/or cleaning both sides of the belt.

As illustrated in FIG. 1, the present invention includes a sensing apparatus 40 having a first sensor array 42 for sensing ink or other contaminants which can be deposited or found on the surface 34 of the belt 12 and a second sensor array 44 for sensing the surface 36 to determine whether ink or contaminants have been deposited thereon. The sensing apparatus 40 is coupled to the controller 32 which receives signals from the sensing apparatus 40 indicating that either one or both surfaces of the belt 12 have been contaminated.

It is well known and commonplace to program and execute controllers for printing, document sensing and/or paper handling control functions and logic with software instructions for conventional or general purpose controllers which include microprocessors. This is taught by various prior patents and commercial products. Such programming or software may, of course, vary depending on the particular functions, software type, and microprocessor or other computer system utilized, but will be available to, or readily programmable without undue experimentation from, functional descriptions, such as those provided herein, or prior knowledge of functions are conventional, together with general knowledge in the software computer arts. That can include object oriented software development environments, such as C++. Alternatively, the disclosed system or method may be implemented partially or fully in hardware, using standard logic circuits or a single chip using VLSI designs.

The sensing apparatus 40 can include any number of known sensing devices for detecting contaminants or other unwanted materials such as an infrared densitometer, reflective sensors, or photodiodes/light source sensors. One acceptable sensing device is described in U.S. Pat. No. 4,967,238 to Bares et al. assigned to Xerox Corporation, having the title "Cleaning Performance Monitor," the relevant portions of which are incorporated by reference. The type of sensing apparatus, depends on materials being sensed and the belt material. For instance, if the belt 12 is made of a material which is transmissive to light, such as KALADEX, the first sensor array 42 could be a linear array of photodiodes and the second sensor array could be a linear light source for transmitting light through the belt to the first sensor array 42. When ink or other contaminants block the transmission of light through the belt, the sensing apparatus 40 would indicate that the belt needs to be clean. In addition, if a light transmissive material is used for the belt 12, it is possible that a reflective sensor located on only one side of the belt might be sufficient to sense for the presence of ink since ink reflects any light which is transmitted thereto and consequently the reflective sensor could sense ink on either the first surface of the belt or the second surface of the belt.

Once ink is sensed by the sensing apparatus 40, the controller 32, which receives a signal from the sensing apparatus indicating that ink is contaminating the belt, sends a signal to a cleaning apparatus 50 which then cleans both sides of the belt 12. The cleaning apparatus 50 includes a first cleaning device 52 and a second cleaning device 54. The first cleaning device 52 is used to clean the surface 36 of the belt 12. The second cleaning device 54 cleans the opposite surface 34 of the belt 12.

Figure 2:
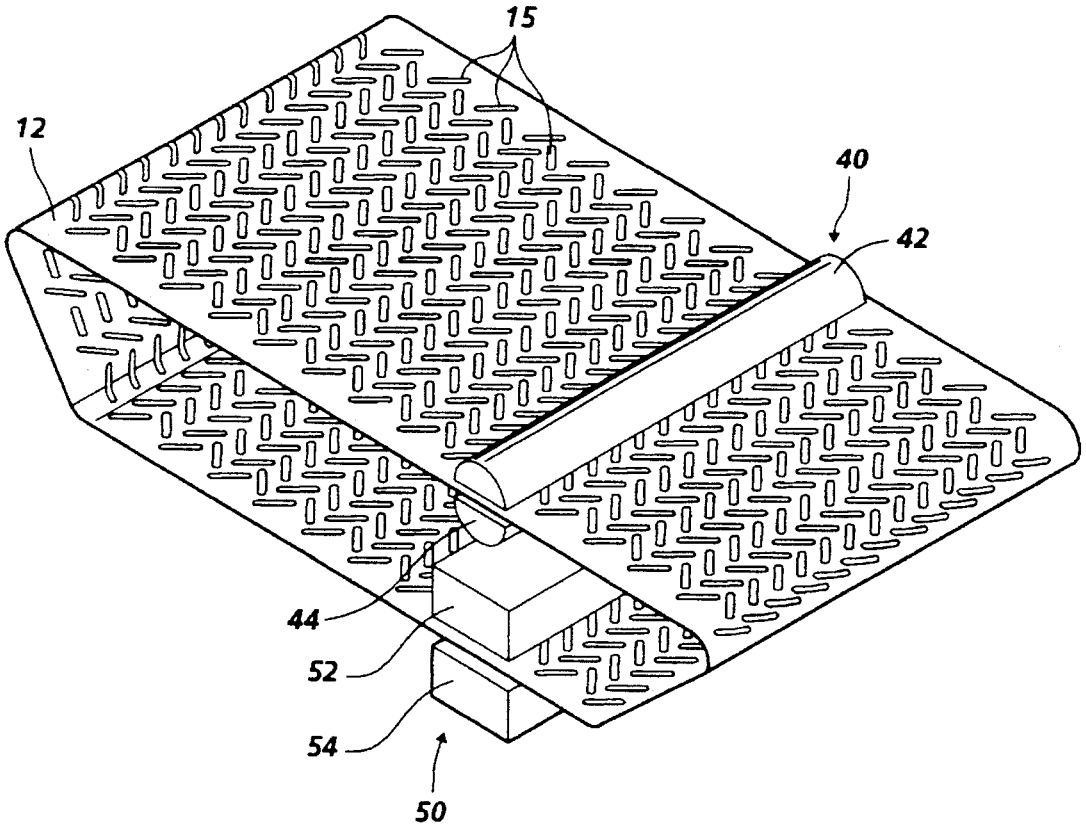
FIG. 2 is a schematic perspective view of a transport belt, sensing apparatus and cleaning apparatus of the present invention of one embodiment.

FIG. 2 illustrates the belt 12 including the plurality of apertures 15, the sensing apparatus 40 and the cleaning apparatus 50. While FIG. 2 shows a location for the sensing apparatus 40 and for the cleaning apparatus 50 with respect to the belt, the illustrated locations are not limiting and other locations for the sensing apparatus 40 and cleaning apparatus 50 are possible.

Figure 3:
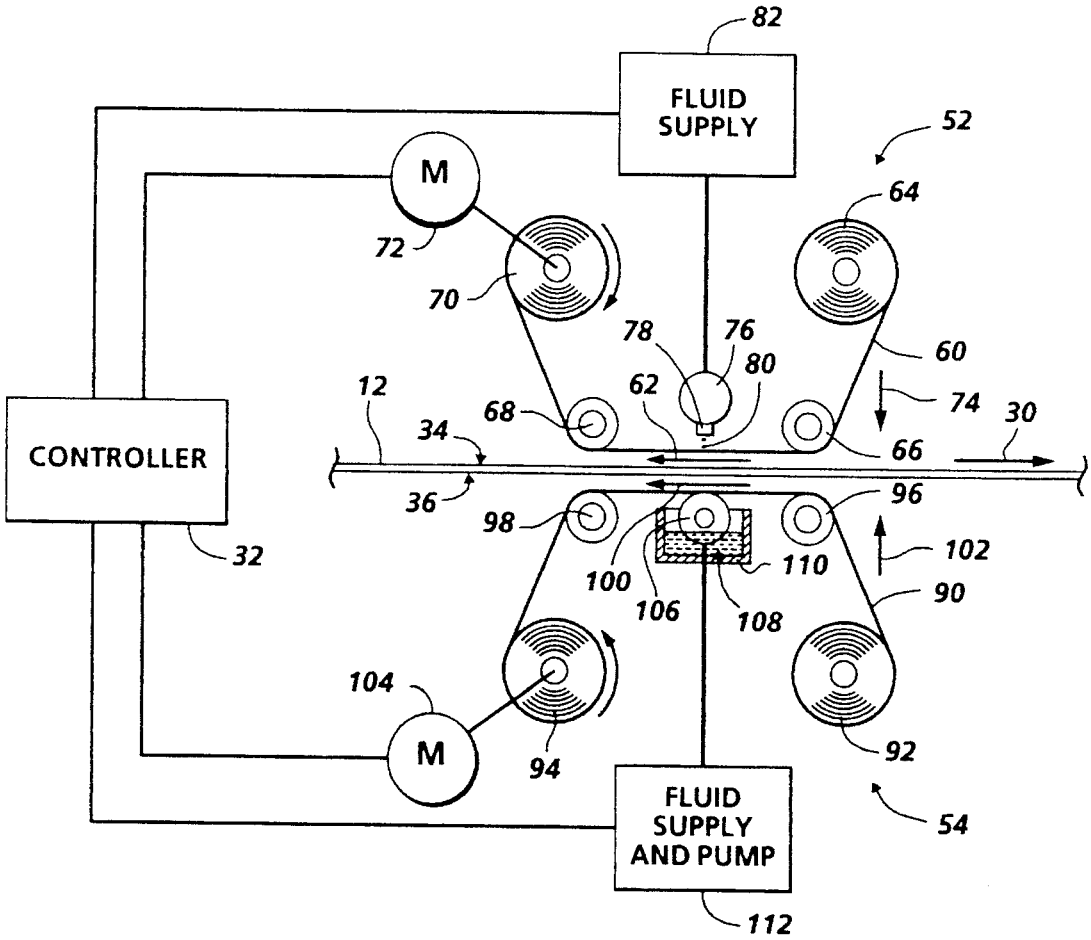
FIG. 3 is a schematic side view of one embodiment of the cleaning apparatus of the present invention.

FIG. 3 illustrates a schematic side view of one embodiment of the cleaning apparatus of the present invention. The first cleaning apparatus 52 includes a cleaning web 60 which is advanced in a direction of an arrow 62 which is opposite the moving direction 30 of the belt 12. The cleaning web 60 is advanced from a supply roll 64 around a first idler roller 66, a second idler roller 68 and onto a takeup roll 70.

When ink or other contaminants are sensed by the sensing apparatus 40, the controller 32 which receives a signal from the sensing apparatus 40 indicating that the belt needs to be cleaned, controls a motor 72 for advancing the takeup roll 70. In addition, the first cleaning device 52 is moved into contact with the belt 12 by moving the first cleaning device 52 in the direction of an arrow 74 as is known by those skilled in the art. In addition to controlling advancement of the takeup roll 70, the controller 32 also controls the supply of cleaning fluid to a pump 76 having an array of nozzles 78 for depositing a cleaning fluid 80 on the inside surface of the web 60. The pump 76, the array of nozzles 78, as well as the cleaning web 60, have a dimension which is sufficiently wide to traverse the entire width of the belt 12 for cleaning the surface 34 thereof. A fluid supply 82 supplies cleaning fluid when necessary to the pump 76 for wetting the web 60.

Particularly effective application of the cleaning liquid to the belt 12 is obtained with a web consisting of highly absorbent fibrous materials. While the absorbent fibrous materials may be employed in the configuration of felt tips or wicks, cleaning materials preferably are in the form of continuous webs to facilitate the resupply of new cleaning liquid to the web. Since the fibrous web material functions as a liquid cleaning applicator for the belt 12 and may also function as an absorbent sheet for removing ink, contaminants and any liquid applied to the belt 12, the fibrous web material should have a sufficient wet strength to prevent ripping or parting when wetted by the cleaning liquid. The fibrous material is preferably softer than the belt 12 so as not to abrade the belt; is lint free; and is not chemically reactive with the belt surface. Also, the web material preferably does not contain any solubles which may be dissolved in the cleaning liquid or cleaning system and has adequate absorbent capacity to absorb the liquid residue resulting from the smearing of the residual ink and cleaning liquid on the belt. Important characteristics of the fibrous material, however, are the ability to transmit cleaning liquid from the cleaning liquid supply to the belt 12 and a good absorption and retention of ink or contaminants after the cleaning has been accomplished. In addition, because the belt 12 includes a plurality of apertures which have interior walls, the web material should have a sufficient amount of loft or nap so that the web material can clean the interior walls of the apertures. The nap should be thick enough so that one web cleans the entire interior walls of the apertures or so that both webs cooperate to clean the same.

Any suitable fibrous material may be used. Typical fibrous cleaning materials include those made from cheesecloth, flannel, rayon, cotton, dacron, polyester fibers, polypropylene fibers, paper and cellulosic fibers, nylon, combinations of rayon and cotton and mixtures thereof. Particularly satisfactory cleaning is obtained with those fibrous webs which are substantially homogenous, thick and have a high absorbent capacity.

The second cleaning device 54 cleans the surface 36 of the belt 12 in a manner substantially similar to that of the first cleaning device 52. A cleaning web 90 supplied by a supply roll 92 is taken up by a take up roll 94 after passing over a first idler roll 96 and a second idler roll 98 in the direction of an arrow 100 to clean the surface 36 of the belt 12. The second cleaning device 54 is moved into contact with the surface 36 in the direction of an arrow 102. A motor 104 under control of the controller 32 moves the take up roll 94 when necessary for moving the web 90 in a direction opposite the belt motion indicated by the arrow 30. To clean the belt 12, a porous absorbent roll 106 is loaded with a cleaning liquid 108 held by a bath 110. When necessary, the porous absorbent roll 106 is moved into contact with the web 90 for applying the cleaning liquid 108 thereto. When a sufficient amount of cleaning liquid 108 is applied to the web 90, the web 90 is moved into contact with the surface 36 of the belt 12 for cleaning thereof. When necessary, a fluid supply and pump 112 under control of the controller 32 supplies additional cleaning fluid 108 to the bath 110 to replenish any cleaning fluid which has been used and applied to the web 90.

As illustrated in FIG. 3, the cleaning liquid is applied to the web material on one surface of the web in an amount sufficient to provide a cleaning amount on the other surface of the web opposite to the applied surface. While the cleaning webs and the belt 12 may move in the same direction, minimum contact length and greater cleaning efficiency have been found to occur when the webs are moved in substantially opposite directions to the belt. By applying the cleaning liquid to the absorbent fibers of the web for a limited period of time, the belt 12 will encounter a wet section of the web saturated with cleaning liquid for removing any ink or other contaminants deposited on the belt. The cleaning liquid is distributed over both surfaces of the belt such that the absorbent cloth absorbs any of the residual inks and contaminants. The belt then passes against progressively cleaner, but still wet sections of the web up to the last point of application of the cleaning liquid. Finally, the belt encounters a dry web, since the cleaning liquid is applied to the web for only a predetermined period of time so that a dry portion of the web remains to remove any remaining liquid. It should be emphasized that because both webs are forced into contact with opposite surfaces of the belt, the nap or fibers of the cleaning webs 60 and 90 may contact one another in the apertures 15 of the belt. This cooperation between both webs tends to remove any of the contaminants and/or ink which have collected on the inside walls of the apertures.

As shown in FIG. 3, the mechanism of applying cleaning liquid to the first web 60 and the second web 90 are different for the first cleaning device 52 and the second cleaning device 54. The present invention, however, is not limited to the mechanisms shown and consequently, the pump 76 including the arrays of nozzles 78 can be used in the second cleaning device 54. Likewise, the bath 110 containing the cleaning liquid 108 applied by the porous absorbent roll 106 could also be used in the first cleaning device 52, but, for example, in a different configuration as now shown.

To facilitate complete removal of any ink, contaminant, and cleaning liquid from the belt 12, it is preferred to provide a cleaning liquid which is readily evaporated. The choice of cleaning liquid, of course, depends on the contaminants and/or type of ink being removed from the belt. If the ink is, for instance, a water-based ink, then the cleaning liquid can also be water. Consequently, it is important that the cleaning liquid be miscible with the ink and/or any anticipated contaminants which may collect on the belt 12. Any residual cleaning liquid containing aqueous materials which remain on the belt 12 after removal of any residual ink, however, can, of course, be removed by un-wetted highly absorbent porous material which comprises the webs 60 and 90.

In recapitulation, there has been described a transport belt cleaning apparatus for cleaning the transport belt of ink or other contaminants. The cleaning apparatus includes a sensor for sensing ink and/or contaminants on the first surface and the second surface of the belt and a cleaning device for cleaning both surfaces. Though the apparatus has been described for an ink jet pagewidth printer, the present invention is applicable to any liquid ink printer having a transport belt in which multiple surfaces may be contaminated with ink or other contaminants. In addition, the present invention can be used with any type of transport belt. Solvents other than water may also be used.

It is, therefore, apparent that there has been provided in accordance with the present invention, a cleaning apparatus for multiple surfaces of a transport belt that fully satisfies the aims and advantages hereinbefore set forth. While this invention has been described in conjunction with a specific embodiment thereof, it is evident that many alternatives, modifications, and variations will be apparent to those skilled in the art. For instance, instead of passing the web across two idler rollers, a single idler roller may be used. Accordingly, it is intended to embrace all such alternatives, modifications and variations that fall within the spirit and broad scope of the appended claims.

I claim:

1. A printing machine of the type in which liquid ink is deposited on a recording medium moving along a path, comprising:

a transport belt moving the recording medium along the path;

a sensor, disposed adjacent said transport belt, sensing contaminants on said transport belt; and a cleaning apparatus, disposed adjacent said transport belt, cleaning said transport belt in response to said sensor sensing contaminants on said transport belt, said cleaning apparatus including a first cleaning device disposed adjacent a first surface of said transport belt and a second cleaning device disposed adjacent a second surface of said transport belt.

2. The printing machine of claim 1, further comprising a controller, in communication with said sensor and said cleaning apparatus, causing said cleaning apparatus to clean said transport belt in response to said sensor sensing contaminants thereon.

3. The printing machine of claim 1, wherein said sensor comprises a linear sensor having a length sufficient to sense contaminants along the width of said transport belt.

4. The printing machine of claim 3, wherein said sensor comprises an infra-red densitometer disposed adjacent a first surface of said transport belt.

5. The printing machine of claim 3, wherein said sensor comprises a reflective sensor.

6. The printing machine of claim 1, wherein said transport belt comprises a light transmissive belt.

7. The printing machine of claim 6, wherein said sensor comprises a linear array of photodiodes disposed adjacently to a first surface of said transport belt.

8. The printing machine of claim 1, wherein said transport belt defines a plurality of apertures having interior walls.

9. A printing machine of the type in which liquid ink is deposited on a recording medium moving along a path, comprising:

a transport belt moving the recording medium along the path;

a sensor, disposed adjacent said transport belt, sensing contaminants on said transport belt;

a liquid ink printhead adapted to deposit ink on the recording medium being moved by said transport belt;

a cleaning apparatus, disposed adjacent said transport belt, cleaning said transport belt in response to said sensor sensing contaminants on said transport belt, said cleaning apparatus including a first cleaning device disposed adjacent a first surface of said transport belt and a second cleaning device disposed adjacent a second surface of said transport belt; and a controller, in communication with said sensor and said cleaning apparatus, causing said cleaning apparatus to clean said transport belt in response to said sensor sensing contaminants thereon.

10. The printing machine of claim 9, wherein said first cleaning device comprises a first flexible web engagable with the first surface of said transport belt.

11. The printing machine of claim 10, wherein said second cleaning device comprises a second flexible web engagable with the second surface of said transport belt.

12. A printing machine of the type in which liquid ink is deposited on a recording medium moving along a path, comprising:

a transport belt moving the recording medium along the path;

a sensor, disposed adjacent said transport belt, sensing contaminants on said transport belt, said sensor including a linear sensor having a length sufficient to sense contaminants along the width of the belt, said sensor including an infra-red densitometer disposed adjacent a first surface of said transport belt and a second infrared densitometer disposed adjacent a second surface of said transport belt; and a cleaning apparatus, disposed adjacent said transport belt, cleaning said transport belt in response to said sensor sensing contaminants on said transport belt.

13. A printing machine of the type in which liquid ink is deposited on a recording medium moving along a path, comprising:

a transport belt moving the recording medium along the path, said transport belt including a light transmissive belt;

a sensor, disposed adjacent said transport belt, sensing contaminants on said transport belt, said sensor including a linear array of photodiodes disposed adjacently to a first surface of said transport belt and a linear light source disposed adjacent a second surface of said transport belt opposed from said linear array of photodiodes; and a cleaning apparatus, disposed adjacent said transport belt, cleaning said transport belt in response to said sensor sensing contaminants on said transport belt.

14. A printing machine of the type in which liquid ink is deposited on a recording medium moving along a path, comprising:

a transport belt moving the recording medium along the path, said transport belt defining a plurality of apertures having interior walls;

a sensor, disposed adjacent said transport belt, sensing contaminants on said transport belt; and a cleaning apparatus, disposed adjacent said transport belt, cleaning said transport belt in response to said sensor sensing contaminants on said transport belt, said cleaning apparatus cleaning the interior walls of the plurality of apertures.

15. The printing machine of claim 14, wherein said cleaning apparatus comprises a first cleaning device disposed adjacent a first surface of said transport belt and a second cleaning device disposed adjacent a second surface of a transport belt.

16. The printing machine of claim 15, wherein said first cleaning device comprises a first flexible web engagable with a first surface of said transport belt.

17. The printing machine of claim 16, wherein said second cleaning device comprises a second flexible web engagable with the second surface of said transport belt.

18. The printing machine of claim 17, wherein said first flexible web includes a nap having a thickness sufficient to clean the interior walls of the plurality of apertures.

19. The printing machine of claim 18, wherein said second flexible web includes a nap of sufficient thickness to enable cleaning of the interior walls of the plurality of apertures.

* * * * *